US009433046B2

(12) United States Patent
Grajcar

(10) Patent No.: US 9,433,046 B2
(45) **Date of Patent: *Aug. 30, 2016**

(54) DRIVING CIRCUITRY FOR LED LIGHTING WITH REDUCED TOTAL HARMONIC DISTORTION

(75) Inventor: Zdenko Grajcar, Crystal, MN (US)

(73) Assignee: ONCE INNOVATIONS, INC., Plymouth, MN (US)

( * ) Notice: Subject to any disclaimer, the term of this patent is extended or adjusted under 35 U.S.C. 154(b) by 768 days.

This patent is subject to a terminal disclaimer.

(21) Appl. No.: 13/355,182

(22) Filed: Jan. 20, 2012

(65) Prior Publication Data

US 2013/0187572 A1 Jul. 25, 2013
US 2015/0359049 A9 Dec. 10, 2015

Related U.S. Application Data

(60) Provisional application No. 61/435,258, filed on Jan. 21, 2011.

(51) Int. Cl.
*H05B 33/08* (2006.01)

(52) U.S. Cl.
CPC ..... *H05B 33/0824* (2013.01)

(58) Field of Classification Search
CPC H05B 33/08; H05B 33/083; H05B 33/0815; H05B 33/0812; H05B 33/0824; H05B 33/0827; H05B 37/00; H05B 37/02
USPC ..... 315/121, 122, 185 R, 192, 291, 294, 315/307, 308, 312
See application file for complete search history.

(56) References Cited

U.S. PATENT DOCUMENTS 4,939,426 A 7/1990 Menard et al.
5,161,481 A 11/1992 Laufer
(Continued)

FOREIGN PATENT DOCUMENTS

CN 101162847 4/2008
CN 102045923 A 5/2011
(Continued)

OTHER PUBLICATIONS

International Preliminary Report on Patentability and Written Opinion of the International Searching Authority issued in International Application No. PCT/US2012/022059 dated Mar. 10, 2014 (in English).
(Continued)

*Primary Examiner* — Thai Pham
(74) *Attorney, Agent, or Firm* — McDermott Will & Emery LLP

(57) ABSTRACT

Conditioning circuits are provided for driving two or more LED groups using a rectified AC input voltage. The conditioning circuits uses analog circuitry to gradually and selectively activate the LED groups based on an instantaneous value of the rectified input voltage. The circuit includes a first series interconnection of a first LED group, a first transistor, and a first resistor, and a second series interconnection of a second LED group, a second transistor, and a second resistor. In one example, the second series interconnection is connected between a drain terminal and a source terminal of the first transistor, while in another example, the second series interconnection is connected between an anode of the first LED group and a source terminal of the first transistor. The first and second LED groups are selectively activated by the rectified voltage applied across the first series interconnection.

14 Claims, 9 Drawing Sheets

(56) References Cited

U.S. PATENT DOCUMENTS

| | | | | |
|---|---|---|---|---|
| 5,495,147 | A | 2/1996 | Lanzisera | |
| 5,575,459 | A | 11/1996 | Anderson | |
| 5,602,709 | A | 2/1997 | Al-Dabbagh | |
| 6,016,038 | A | 1/2000 | Mueller et al. | |
| 6,166,496 | A | 12/2000 | Lys et al. | |
| 6,357,889 | B1 | 3/2002 | Duggal et al. | |
| 6,461,019 | B1 | 10/2002 | Allen | |
| 6,636,003 | B2 | 10/2003 | Rahm et al. | |
| 6,933,707 | B2 | 8/2005 | Allen | |
| 7,038,399 | B2 | 5/2006 | Lys et al. | |
| 7,081,722 | B1 | 7/2006 | Huynh et al. | |
| 7,102,334 | B2 | 9/2006 | Wiegand et al. | |
| 7,102,344 | B1 | 9/2006 | Short | |
| 7,213,942 | B2 | 5/2007 | Jiang et al. | |
| 7,288,902 | B1 | 10/2007 | Melanson | |
| 7,352,138 | B2 | 4/2008 | Lys et al. | |
| 7,358,679 | B2 | 4/2008 | Lys et al. | |
| 7,378,805 | B2 | 5/2008 | Oh et al. | |
| 7,391,630 | B2 | 6/2008 | Acatrinei | |
| 7,425,801 | B2 | 9/2008 | Ozaki | |
| 7,489,086 | B2 | 2/2009 | Miskin et al. | |
| 7,531,843 | B2 | 5/2009 | Lin et al. | |
| 7,663,229 | B2 | 2/2010 | Lu et al. | |
| 7,709,774 | B2 | 5/2010 | Schulz et al. | |
| 7,737,643 | B2 | 6/2010 | Lys | |
| 7,781,979 | B2 | 8/2010 | Lys | |
| 7,791,289 | B2 | 9/2010 | Oosterbaan et al. | |
| 7,847,486 | B2 * | 12/2010 | Ng | 315/119 |
| 7,859,196 | B2 | 12/2010 | Lee et al. | |
| 7,863,831 | B2 | 1/2011 | Vos | |
| D632,837 | S | 2/2011 | Grajcar | |
| 7,880,400 | B2 | 2/2011 | Zhou et al. | |
| 7,902,769 | B2 | 3/2011 | Shteynberg et al. | |
| 7,936,135 | B2 | 5/2011 | Hum et al. | |
| D641,520 | S | 7/2011 | Grajcar | |
| 7,977,892 | B2 | 7/2011 | Lee et al. | |
| 8,102,167 | B2 | 1/2012 | Irissou et al. | |
| 8,120,279 | B2 | 2/2012 | Oosterbaan et al. | |
| 8,134,303 | B2 | 3/2012 | Lys | |
| 8,159,125 | B2 | 4/2012 | Miao | |
| 8,159,139 | B2 | 4/2012 | Blaut et al. | |
| 8,164,276 | B2 | 4/2012 | Kuwabara | |
| 8,188,679 | B2 | 5/2012 | Hoogzaad | |
| 8,188,687 | B2 | 5/2012 | Lee et al. | |
| 8,324,642 | B2 | 12/2012 | Grajcar | |
| 8,324,840 | B2 | 12/2012 | Shteynberg et al. | |
| 8,373,363 | B2 | 2/2013 | Grajcar | |
| 8,384,307 | B2 | 2/2013 | Grajcar | |
| 8,531,136 | B2 | 9/2013 | Grajcar | |
| 8,593,044 | B2 | 11/2013 | Grajcar | |
| 8,598,799 | B2 | 12/2013 | Tai et al. | |
| 8,643,308 | B2 | 2/2014 | Grajcar | |
| D701,497 | S | 3/2014 | Grajcar | |
| 8,796,955 | B2 | 8/2014 | Grajcar | |
| 8,872,445 | B2 | 10/2014 | Egawa et al. | |
| D719,684 | S | 12/2014 | Grajcar | |
| 8,922,136 | B2 | 12/2014 | Grajcar | |
| 2002/0047606 | A1 | 4/2002 | Guthrie et al. | |
| 2002/0097007 | A1 | 7/2002 | Koncz et al. | |
| 2002/0149929 | A1 | 10/2002 | Evans et al. | |
| 2003/0164809 | A1 | 9/2003 | Leung | |
| 2005/0212458 | A1 | 9/2005 | Powers, Jr. et al. | |
| 2005/0280964 | A1 | 12/2005 | Richmond et al. | |
| 2006/0214603 | A1 | 9/2006 | Oh et al. | |
| 2007/0182338 | A1 | 8/2007 | Shteynberg et al. | |
| 2007/0258240 | A1 | 11/2007 | Ducharme et al. | |
| 2008/0049399 | A1 | 2/2008 | Lu et al. | |
| 2008/0116816 | A1 | 5/2008 | Neuman et al. | |
| 2008/0203936 | A1 | 8/2008 | Mariyama et al. | |
| 2008/0211421 | A1 | 9/2008 | Lee et al. | |
| 2009/0080187 | A1 | 3/2009 | Chou | |
| 2009/0160370 | A1 | 6/2009 | Tai et al. | |
| 2009/0267534 | A1 | 10/2009 | Godbole et al. | |
| 2010/0013402 | A1 | 1/2010 | Chaffai et al. | |
| 2010/0060175 | A1 | 3/2010 | Lethellier | |
| 2010/0072903 | A1 | 3/2010 | Blaut et al. | |
| 2010/0164579 | A1 | 7/2010 | Acatrinei | |
| 2010/0165677 | A1 | 7/2010 | Wang et al. | |
| 2010/0237800 | A1 | 9/2010 | Kang et al. | |
| 2010/0308739 | A1 | 12/2010 | Shteynberg et al. | |
| 2010/0308751 | A1 | 12/2010 | Nerone | |
| 2011/0018465 | A1 | 1/2011 | Ashdown | |
| 2011/0031890 | A1 | 2/2011 | Stack | |
| 2011/0037387 | A1 | 2/2011 | Chou et al. | |
| 2011/0037415 | A1 | 2/2011 | Juestel et al. | |
| 2011/0084619 | A1 * | 4/2011 | Gray et al. | 315/185 R |
| 2011/0089830 | A1 | 4/2011 | Pickard et al. | |
| 2011/0101883 | A1 | 5/2011 | Grajcar | |
| 2011/0273103 | A1 * | 11/2011 | Hong | 315/193 |
| 2012/0081009 | A1 | 4/2012 | Shteynberg et al. | |
| 2012/0153833 | A1 | 6/2012 | Mikani et al. | |
| 2012/0268918 | A1 | 10/2012 | Grajcar | |
| 2013/0134888 | A1 | 5/2013 | Grajcar | |
| 2013/0153938 | A1 | 6/2013 | Grajcar | |
| 2013/0157394 | A1 | 6/2013 | Grajcar | |
| 2013/0187572 | A1 | 7/2013 | Grajcar | |
| 2013/0193864 | A1 | 8/2013 | Angeles | |
| 2013/0342120 | A1 | 12/2013 | Creusen et al. | |
| 2014/0098531 | A1 | 4/2014 | Grajcar | |
| 2014/0103823 | A1 | 4/2014 | Kahlman et al. | |
| 2014/0111091 | A1 | 4/2014 | Grajcar et al. | |
| 2014/0159584 | A1 | 6/2014 | Grajcar | |
| 2014/0197741 | A1 * | 7/2014 | Sakai et al. | 315/123 |
| 2014/0197751 | A1 | 7/2014 | Grajcar | |
| 2014/0210352 | A1 | 7/2014 | Grajcar | |
| 2015/0061534 | A1 | 3/2015 | Grajcar | |

FOREIGN PATENT DOCUMENTS

| | | | |
|---|---|---|---|
| EP | 1502483 | | 2/2005 |
| EP | 1610593 | A2 | 12/2005 |
| EP | 2094063 | | 8/2009 |
| JP | 2004248333 | | 9/2004 |
| JP | 2006147933 | | 6/2006 |
| JP | 2006244848 | | 9/2006 |
| JP | 2007511903 | | 5/2007 |
| JP | 2007-299788 | A | 11/2007 |
| JP | 2008218043 | | 9/2008 |
| JP | 4241870 | B2 | 3/2009 |
| JP | 2009117036 | | 5/2009 |
| JP | 2009123427 | | 6/2009 |
| JP | 2009-182074 | A | 8/2009 |
| JP | 2011004071 | | 1/2011 |
| JP | 5550716 | B2 | 7/2014 |
| JP | 5676611 | | 1/2015 |
| WO | 0106630 | | 1/2001 |
| WO | 2005084080 | | 9/2005 |
| WO | 2014200960 | A1 | 12/2014 |

OTHER PUBLICATIONS

"Hazards of Harmonics and Neutral Overloads", White Paper #26, 2003, pp. 1-8, American Power Conversion.

"Great Green Hope: The Corporate Love Affair with Algae", Todd Taylor, Biomass Magazine, Apr. 2010 issue.

International Preliminary Report on Patentability, issue in International Patent Application No. PCT/US2010/045467, dated Feb. 14, 2012.

International Search Report and Written Opinion, issued in International Patent Application No. PCT/US2010/045467, dated Oct. 7, 2010.

International Preliminary Report on Patentability, issued in International Patent Application No. PCT/US2010/054506, dated May 1, 2012.

International Search Report and Written Opinion issued in International Patent Application No. PCT/US2010/054506, dated Dec. 28, 2010.

English translation of JP office action dated Mar. 4, 2014 for JP application No. 2012-524899.

English translation of CN office action dated Jan. 24, 2014 for CN application No. 2010800468806.

English translation of JP office action dated Apr. 1, 2014 for JP application No. 2012-524901.

(56) References Cited

OTHER PUBLICATIONS

English translation of CN office action dated Feb. 10, 2014 for CN application No. 201080046791.1.
English translation of second CN office action dated Sep. 3, 2014 for CN application No. 201080046791.1.
International Preliminary Report on Patentability and Written Opinion of the International Searching Authority issued in International Patent Application No. PCT/US2012/022059, dated Mar. 25, 2014.
Chinese Office Action issued in corresponding Chinese Patent Application No. 201280009746.8, mailed on Jun. 25, 2015, with English translation.
Office Action dated Mar. 12, 2015 issued in U.S. Appl. No. 13/676,358.
Office Action dated Apr. 8, 2015 issued in U.S. Appl. No. 14/514,612.
Office Action dated Sep. 22, 2014 issued in U.S. Appl. No. 14/144,298.
Office Action dated Jan. 28, 2015 issued in U.S. Appl. No. 14/160,721.
Office Action dated Aug. 15, 2014 issued in U.S. Appl. No. 14/160,721.
Office Action dated Oct. 3, 2014 issued in U.S. Appl. No. 14/170,760.
International Search Report dated Feb. 20, 2013, issued in International Application No. PCT/US2012/069728.
"Sequential Linear LED Driver, CL8800", Supertex Inc., Sunnyvale, California, 2012.
"TPS92411x Floating Switch for Offline AC Linear Direct Drive of LEDs with Low Ripple Current", Texas Instruments, Oct. 2013.
English translation of the Notice of Rejection dated Dec. 15, 2015, issued in corresponding Japanese Application No. 2013-550625.

* cited by examiner

DRIVING CIRCUITRY FOR LED LIGHTING WITH REDUCED TOTAL HARMONIC DISTORTION

CROSS-REFERENCE TO RELATED APPLICATION

The present application claims the benefit of priority from U.S. Provisional Patent Application Ser. No. 61/435,258, entitled "CURRENT CONDITIONER WITH REDUCED TOTAL HARMONIC DISTORTION" and filed on Jan. 21, 2011, which is hereby incorporated by reference in its entirety for all purposes.

BACKGROUND

Lighting circuits that use light emitting diodes (LEDs) to produce illumination typically have higher energy efficiency and longer service life than equivalent incandescent bulbs, fluorescent lamps, or other lighting sources.

LEDs, however, conduct current in only one direction, and therefore use direct current (DC) to function. In order to function efficiently when powered by an alternating current (AC) power source, a LED-based lighting circuits includes a rectifier circuit to convert a sinusoidal AC input power signal into a half-wave or a full-wave rectified DC power signal. The rectified sinusoidal signal has a variable value that follows a sinusoidal envelope. Because LEDs (and LED lighting circuits) have a threshold voltage below which the LEDs are powered off and neither conduct current or emit light, a LED (or LED lighting circuit) powered by a rectified sinusoidal signal will in general repeatedly turn on and off depending on whether the instantaneous value of the rectified sinusoidal signal exceeds or not the threshold voltage of the LED.

In order to make efficient use of the input power, LED lighting circuits can be designed such that different numbers of LEDs are powered at different times during each cycle. In general, the lighting circuit includes a voltage sensing circuit, for measuring the instantaneous value of the rectified sinusoidal signal, and a microprocessor for determining which LEDs should be powered based on the measured value of the rectified sinusoidal signal. The microprocessor controls a set of digital switches for selectively activating various combinations of LEDs based on the microprocessor's control. For example, the microprocessor may activate a first set of LEDs at the beginning and end of a cycle, when the instantaneous value of the rectified sinusoidal signal is low, and the microprocessor may activate a series connection of two or more sets of LEDs in the middle of the cycle, when the instantaneous value of the rectified sinusoidal signal is high.

The activation and deactivation of the sets of LEDs by the digital switches, however, causes elevated levels of harmonic distortion in the LED lighting circuit and the power lines providing the AC driving signal. In addition, the driving of non-linear LED loads causes power factor distortion in the LED lighting circuit and the power lines providing the AC driving signal. The harmonic and power factor distortions both contribute to decreases in the total efficiency of the LED lighting, as the distortion causes harmonic currents to travel through the power lines providing the AC driving signal.

A need therefore exists for driving circuitry for LED lighting applications which produces minimal total harmonic distortion.

SUMMARY

In one aspect, a conditioning circuit for driving two or more LED groups using a rectified AC input voltage is provided. The circuit includes a first series interconnection of a first light-emitting diode (LED) group, a first transistor, and a first resistor, and a second series interconnection of a second LED group, a second transistor, and a second resistor. The second series interconnection is connected between a drain terminal and a source terminal of the first transistor, and the first and second LED groups are selectively activated by a variable voltage applied across the first series interconnection. The first resistor is coupled between the source terminal and a gate terminal of the first transistor. As a result, the first transistor transitions from a conducting state to a non-conducting state when the variable voltage exceeds a first threshold. In addition, the first and second LED groups have respective threshold voltages, such that the first LED group is activated when the variable voltage exceeds the threshold voltage of the first LED group, and the second LED group is activated when the variable voltage exceeds the sum of the threshold voltages of the first and second LED groups.

In another aspect, a second conditioning circuit for driving two or more LED groups using a rectified AC input voltage is provided. The second circuit includes the first and second series interconnections of a LED group, a transistor, and a resistor. In the second circuit, however, the second series interconnection is connected between an anode of the first LED group and a source terminal of the first transistor, and the first and second LED groups are selectively activated by a variable voltage applied across the first series interconnection. The first and second LED groups have respective threshold voltages, such that the first LED group is activated when the variable voltage exceeds the threshold voltage of the first LED group and does not exceed a first threshold at which the first transistor transitions into a non-conducting state, and the second LED group is activated when the variable voltage exceeds the threshold voltage of the second LED groups.

It is understood that various configurations of the subject technology will become readily apparent to those skilled in the art from the disclosure, wherein various configurations of the subject technology are shown and described by way of illustration. As will be realized, the subject technology is capable of other and different configurations and its several details are capable of modification in various other respects, all without departing from the scope of the subject technology. Accordingly, the summary, drawings and detailed description are to be regarded as illustrative in nature and not as restrictive.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF PREFERRED EMBODIMENTS

Figure 1A:
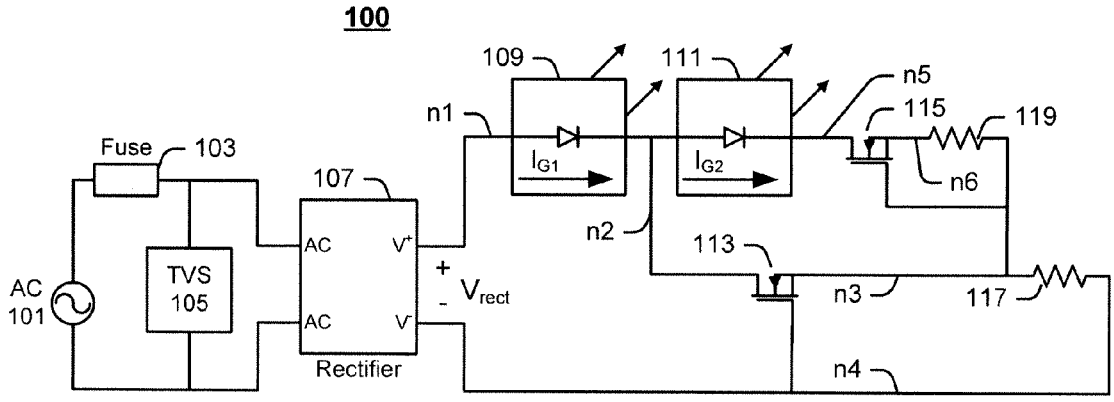
FIG. 1A is a schematic diagram showing a conditioning circuit for driving two LED groups using a rectified AC input voltage.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Driving circuitry for powering light emitting diode (LED) lights generally rely on digital circuitry to measure the instantaneous value of a driving voltage, on a microprocessor to identify LEDs to activate based on the measured value, and on digital switches to selectively activate the identified LEDs. The digital circuitry, however, reduces the overall efficiency of the LED lighting by causing harmonic distortion and power factor distortion in the LED light and the associated power line. In order to reduce the harmonic distortion and power factor distortion caused by the digital circuitry, a current conditioning circuit is presented for selectively routing current to various LED groups in a LED light. The current conditioning circuit uses analog components and circuitry for operation, and produces minimal harmonic distortion and power factor distortion.

The current conditioning circuitry is provided to selectively route current to different LED groups depending on the instantaneous value of an AC input voltage. In a preferred embodiment, the conditioning circuitry includes only analog circuit components and does not include digital components or digital switches for operation.

The circuitry relies on depletion-mode metal-oxide-semiconductor field-effect transistor (MOSFET) transistors for operation. In a preferred embodiment, the depletion MOSFET transistors have a high resistance between their drain and source terminals, and switch between conducting and non-conducting states relatively slowly. The depletion-mode MOSFET transistors may conduct current between their drain and source terminals when a voltage $V_{GS}$ between the gate and source terminals is zero or positive and the MOSFET transistor is operating in the saturation (or active, or conducting) mode (or region, or state). The current through the depletion-mode MOSFET transistor, however, may be restricted if a negative $V_{GS}$ voltage is applied to the terminals and the MOSFET transistor enters the cutoff (or non-conducting) mode (or region, or state). The MOSFET transistor transitions between the saturation and cutoff modes by operating in the linear or ohmic mode or region, in which the amount of current flowing through the transistor (between the drain and source terminals) is dependent on the voltage between the gate and source terminals $V_{GS}$. In one example, the depletion MOSFET transistors preferably have an elevated resistance between drain and source (when operating in the linear mode) such that the transistors switch between the saturation and cutoff modes relatively slowly. The depletion MOSFET transistors switch between the saturation and cutoff modes by operating in the linear or ohmic region, thereby providing a smooth and gradual transition between the saturation and cutoff modes. In one example, a depletion-mode MOSFET transistor may have a threshold voltage of −2.6 volts, such that the depletion-mode MOSFET transistor allows substantially no current to pass between the drain and source terminals when the gate-source voltage $V_{GS}$ is below −2.6 volts. Other values of threshold voltages may alternatively be used.

FIG. 1A is a schematic diagram showing a conditioning circuit 100 for driving two LED groups using a rectified AC input voltage. The conditioning circuit 100 uses analog circuitry to selectively route current to one or both of the LED groups based on the instantaneous value of the AC input voltage.

The conditioning circuit 100 receives an AC input voltage from an AC voltage source 101, such as a power supply, an AC line voltage, or the like. The AC voltage source 101 is coupled in series with a fuse 103, and the series interconnection of the AC voltage source 101 and the fuse 103 is coupled in parallel with a transient voltage suppressor (TVS) 105 or other surge protection circuitry. The series interconnection of the AC voltage source 101 and the fuse 103 is further coupled in parallel with two input terminals of a voltage rectifier 107. In one example, the voltage rectifier 107 can include a diode bridge rectifier that provides full-wave rectification of an input sinusoidal AC voltage waveform. In other examples, other types of voltage rectification circuitry can be used.

Voltage rectifier 107 functions as a source of variable DC voltage, and produces a rectified voltage $V_{rect}$ between its two output terminals $V^+$ and $V^-$. The rectified voltage $V_{rect}$ corresponds to a rectified version of the AC driving voltage. In general, the rectified voltage $V_{rect}$ is a full-wave rectified DC voltage. The rectified voltage $V_{rect}$ is used as the input DC voltage for driving the LED groups 109 and 111 of the conditioning circuit 100. In particular, the rectified voltage $V_{rect}$ is used as an input voltage for driving two series interconnections of an LED group, a transistor, and a resistor.

A first series interconnection of a first LED group 109, a first n-channel depletion MOSFET transistor 113 (coupled by the drain and source terminals), and a first resistor 117 is coupled between the output terminals $V^+$ and $V^-$ of the voltage rectifier 107. The first LED group 109 has its anode coupled to the terminal $V^+$ (node n1), and its cathode coupled to the drain terminal of first depletion MOSFET transistor 113 (node n2). The source terminal of transistor 113 is coupled to a first terminal of resistor 117 (node n3), while both the gate terminal of transistor 113 and the second terminal of resistor 117 are coupled to the terminal $V^-$ (node n4) of the voltage rectifier 107, such that the voltage across the first resistor 117 serves as the biasing voltage $V_{GS}$ between the gate and source terminals of the first transistor 113.

A second series interconnection of a second LED group 111, a second re-channel depletion MOSFET transistor 115 (coupled by the drain and source terminals), and a second resistor 119 is coupled between the drain and source terminals of the first transistor 113. In particular, the anode of second LED group 111 is coupled to node n2, while the cathode of the second LED group 111 is coupled at node n5 to the drain terminal of the second transistor 115. The source terminal of the second transistor 115 is coupled to a first terminal of the second resistor 119 at node n6, while both the gate terminal of the second transistor 115 and the second terminal of the second resistor 119 are coupled to node n3 and the source terminal of the first transistor 113. The voltage across the second resistor 119 thereby serves as the biasing voltage $V_{GS}$ between the gate and source terminals of the second transistor 115.

Each of the first and second LED groups 109 and 111 has a forward voltage (or threshold voltage). The forward voltage generally is a minimum voltage required across the LED group in order for current to flow through the LED group, and/or for light to be emitted by the LED group. The first and second LED groups 109 and 111 may have the same forward voltage (e.g., 50 volts), or the first and second LED groups 109 and 111 may have different forward voltages (e.g., 60 volts and 40 volts, respectively).

In operation, in the driving circuitry 100 of FIG. 1A, one or both of the LED groups 109 and 111 may conduct current depending on whether the forward voltage of one or both of the LED groups 109 and 111 is satisfied. The operation of the LED driving circuitry 100 of FIG. 1A will be explained with reference to the voltage timing diagram of FIG. 1B.

Figure 1B:
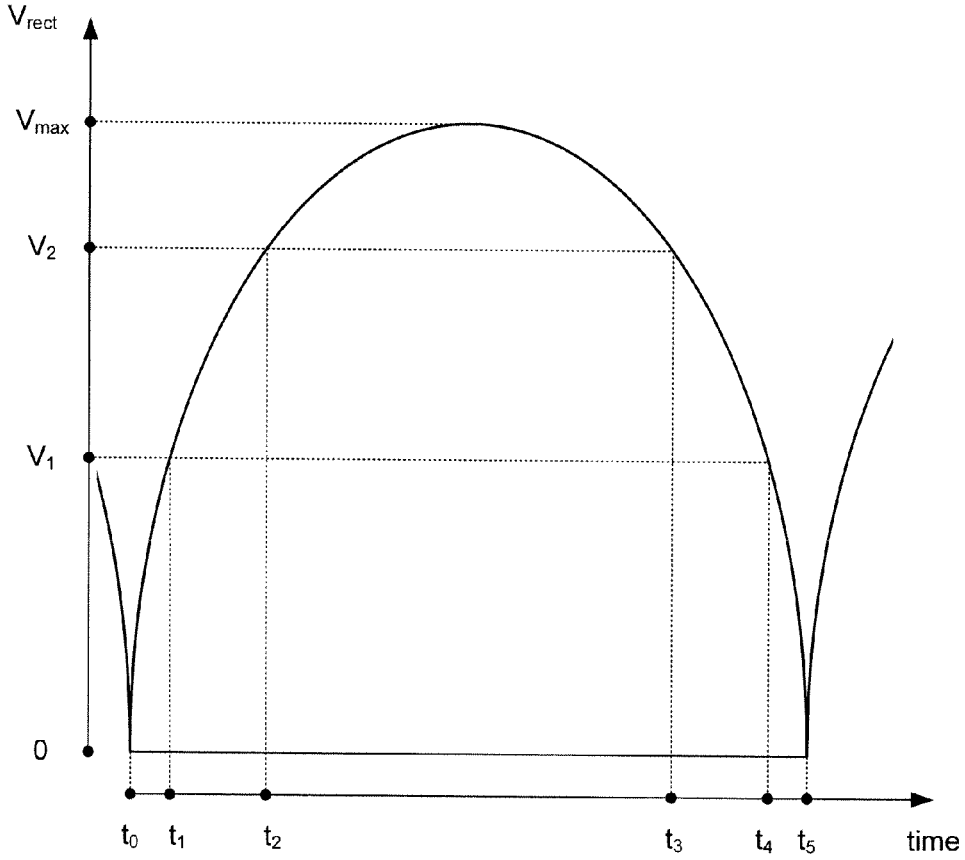
FIGS. 1B, 1C, and 1D respectively are a first voltage timing diagram, a current timing diagram, and a second voltage timing diagram illustratively showing the operation of the conditioning circuit of FIG. 1A.

FIG. 1B is a voltage timing diagram showing the rectified voltage $V_{rect}$ during one cycle. The rectified voltage $V_{rect}$ may be applied at the output of voltage rectifier 107 to the LED groups 109 and 111, as shown in driving circuitry 100 of FIG. 1A.

The exemplary cycle of the rectified voltage $V_{rect}$ shown in FIG. 1B begins at time $t_0$ with the rectified voltage $V_{rect}$ having a value of 0V (0 volts). The rectified voltage $V_{rect}$ undergoes a half-sine cycle between times $t_0$ and $t_5$. Between times $t_0$ and $t_1$, the value of the rectified voltage $V_{rect}$ remains below the forward voltage of the first LED group 109, and no current flows through the first LED group 109. As the rectified voltage $V_{rect}$ reaches a value of $V_1$, the forward voltage of the first LED group 109 is reached and current gradually begins to flow through the first LED group 109. At this time, the first depletion MOSFET transistor 113 is in a conducting state such that the current flowing from the rectifier 107 through the first LED group 109 flows through the MOSFET transistor 113 (from drain to source terminals) and the first resistor 117.

As the rectified voltage $V_{rect}$ increases in value from $V_1$ to $V_2$, the value of the current flowing through the first LED group 109, the first depletion MOSFET transistor 113, and the first resistor 117 increases. The increase in current through the first resistor 117 causes the voltage across the first resistor 117 to increase, and the corresponding reverse voltage between the gate and source terminals of the first depletion MOSFET transistor 113 to increase. As the reverse gate-source voltage increases, however, the first depletion MOSFET transistor 113 begins to transition out of saturation and into the "linear" or "ohmic" mode or region of operation. The first depletion MOSFET transistor 113 may thus begin to shut down and to conduct less current as the value of the rectified voltage $V_{rect}$ reaches the value $V_2$.

Meanwhile, as the rectified voltage $V_{rect}$ reaches the value $V_2$ (at time $t_2$), the rectified voltage $V_{rect}$ is reaching or exceeding the sum of the forward voltage of the first and second LED groups 109 and 111. As a result, the second LED group 111 begins to conduct current, and the current flowing through the first LED group 109 begins to flow through the series interconnection of the second LED group 111, the second depletion MOSFET transistor 115, and the second and first resistors 119 and 117. As $V_{rect}$ exceeds $V_2$ and the first depletion MOSFET transistor 109 enters the cutoff mode, most or all of the current flowing through the first LED group 109 flows through the second LED group 111.

Thus, during the first half of the cycle, no current initially flows through either of the first and second LED groups 109 and 111 (period $[t_0, t_1]$). However, as the value of $V_{rect}$ reaches or exceeds $V_1$, current begins to flow through the first LED group 109 which starts to emit light (period $[t_1, t_2]$) while the second LED group 111 remains off. Finally, as the value of $V_{rect}$ reaches or exceeds $V_2$, current begins to flow through both the first and second LED groups 109 and 111 which both emit light (period after $t_2$).

During the second half of the cycle, the rectified voltage $V_{rect}$ decreases from a maximum of $V_{max}$ back to 0 volts. During this period, the second and first LED groups 111 and 109 are sequentially turned off and gradually stop conducting current. In particular, while the value of $V_{rect}$ remains above $V_2$, both the first and second LED groups 109 and 111 remain in the conducting state. However, as the value of $V_{rect}$ reaches or dips below $V_2$ (at time $t_3$), $V_{rect}$ no longer reaches or exceeds the sum of the forward voltage of the first and second LED groups 109 and 111, and the second LED group 111 begins to turn off and to stop conducting current. At around the same time, the voltage drop across the first resistor drops below the threshold voltage of the first depletion MOSFET transistor 109, and the first depletion MOSFET transistor 109 enter the linear or ohmic operation mode and begins to conduct current once again. As a result, current flows through the first LED group 109, the first depletion MOSFET transistor 109, and the first resistor 117, and the first LED group 109 thus continues to emit light. As the value of $V_{rect}$ reaches or dips below $V_1$ (at time $t_4$), however, $V_{rect}$ no longer reaches or exceeds the forward voltage of the first LED group 109, and the first LED group 109 begins to turn off and stop conducting current. As a result, both the first and second LED groups 109 and 111 turn off and stop emitting light during the period $[t_4, t_5]$.

Figure 1C:
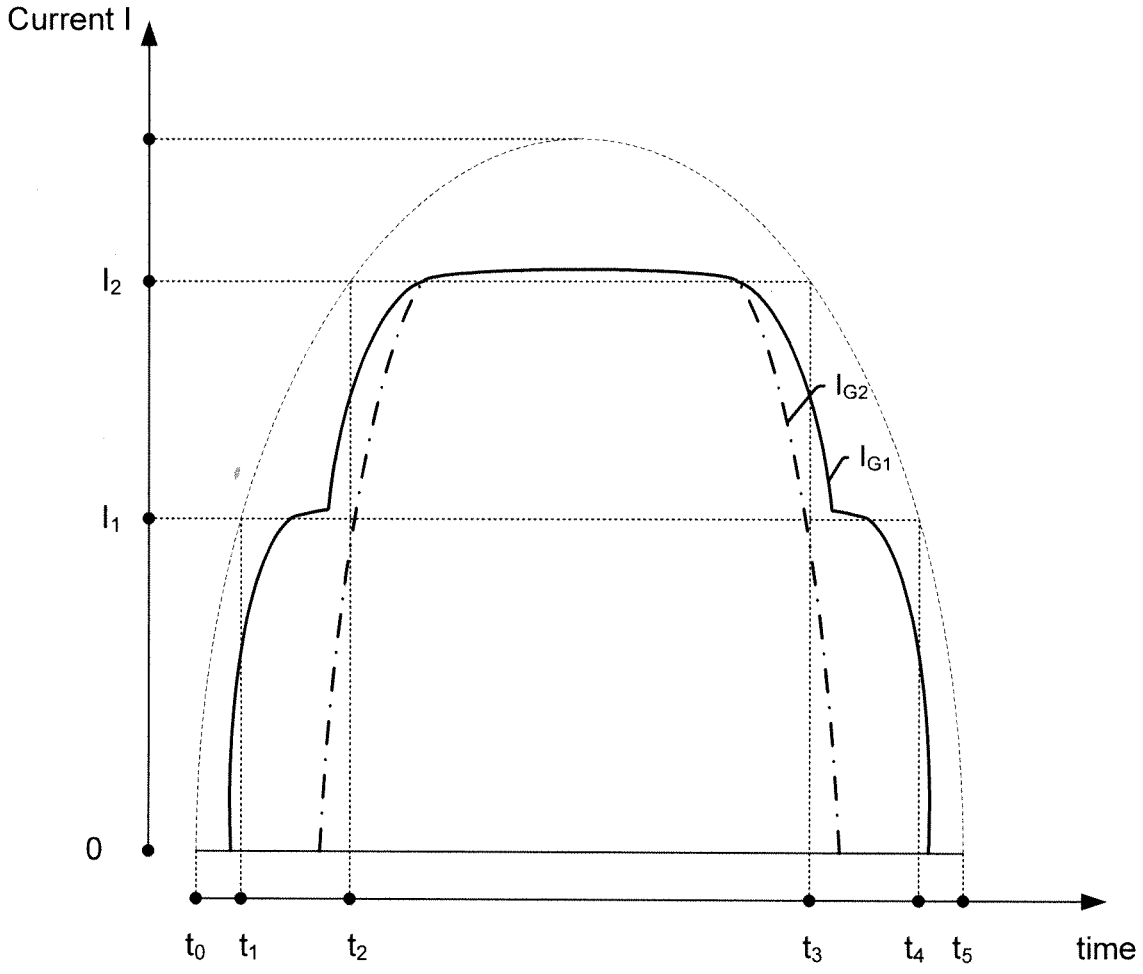

FIG. 1C is a current timing diagram showing the currents $I_{G1}$ and $I_{G2}$ respectively flowing through the first and second LED groups 109 and 111 during one cycle of the rectified voltage $V_{rect}$.

As described in relation to FIG. 1B, the current $I_{G1}$ through the first LED group 109 begins flowing around time $t_1$, and increases to a first value $I_1$. The current $I_{G1}$ continues to flow through the first LED group 109 from around time $t_1$ to around time $t_4$. Between times $t_2$ and $t_3$, the current $I_{G2}$ flows through the second LED group 111, and reaches a second value $I_2$. During the time period $[t_2, t_3]$, the current $I_{G1}$ increases to the value $I_2$.

In general, electrical parameters of the components of driving circuit 100 can be selected to adjust the functioning of the circuit 100. For example, the forward voltages of the first and second LED groups 109 and 111 may determine the value of the voltages $V_1$ and $V_2$ at which the first and second LED groups are activated. In particular, the voltage $V_1$ may be substantially equal to the forward voltage of the first LED group, while the voltage $V_2$ may be substantially equal to the sum of the forward voltages of the first and second LED groups. In one example, the forward voltage of the first LED group may be set to a value of 60V, for example, while the forward voltage of the second LED group may be set to a value of 40V, such that the voltage $V_1$ is approximately equal to 60V and the voltage $V_2$ is approximately equal to 100V. In addition, the value of the first resistor 117 may be set such that the first depletion MOSFET transistor 113 enters a non-conducting state when the voltage $V_{rect}$ reaches a value of $V_2$. As such the value of the first resistor 117 may be set based on the threshold voltage of the first depletion MOSFET transistor 113, the drain-source resistance of the first depletion MOSFET transistor, and the voltages $V_1$ and $V_2$. In one example, the first resistor may have a value of around 31.6 ohms.

Figure 1D:
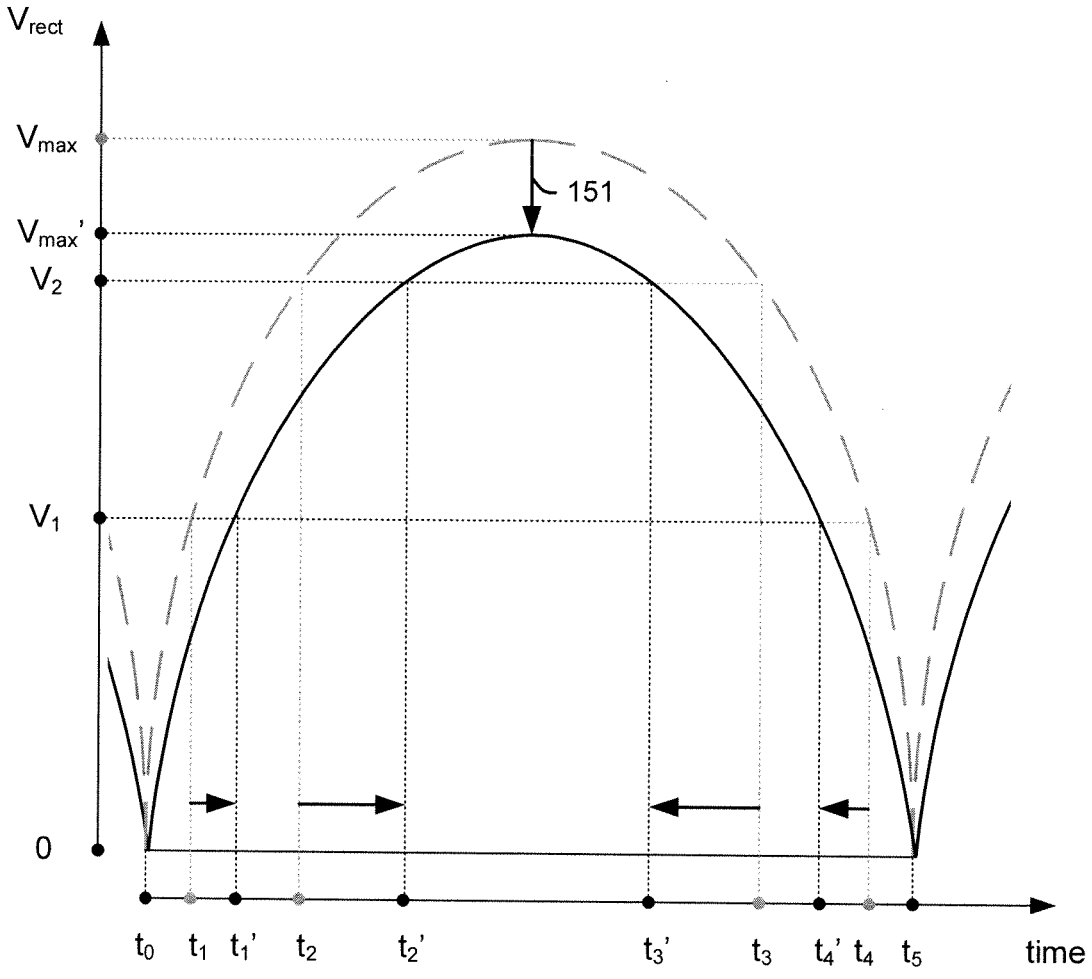

The conditioning circuitry 100 of FIG. 1A can be used to provide dimmable lighting using the first and second LED groups 109 and 111. The conditioning circuitry can, in particular, provide a variable lighting intensity based on the amplitude of the rectified driving voltage $V_{rect}$. FIG. 1D is a voltage timing diagram showing the effects of a reduced driving voltage amplitude on the LED lighting circuitry 100.

As shown in FIG. 1D, the amplitude of the driving voltage $V_{rect}$ has been reduced from a value of $V_{max}$ to a value of $V_{max}'$ at 151. The amplitude of the driving voltage $V_{rect}$ may have been reduced through the activation of a potentiometer, a dimmer switch, or other appropriate means. While the amplitude of the driving voltage is reduced, the threshold voltages $V_1$ and $V_2$ remain constant as the threshold voltages are set by parameters of the components of the circuit 100.

Because the driving voltage $V_{rect}$ has a lower amplitude, the driving voltage takes a time $[t_0, t_1']$ to reach the first threshold voltage $V_1$ during the first half of each cycle that is longer than the time $[t_0, t_1]$. Similarly, the driving voltage takes a time $[t_0, t_2']$ to reach the second threshold voltage $V_2$ that is longer than the time $[t_0, t_2]$. Additionally, the lower-amplitude driving voltage reaches the second threshold sooner (at a time $t_3'$, which occurs sooner than the time $t_3$) during the second half of each cycle, and similarly reaches the first threshold sooner (at a time $t_4'$, which occurs sooner than the time $t_4$), during the second half of each cycle. As a result, the time-period $[t_1', t_4']$ during which current flows through the first LED group 109 is substantially reduced with respect to the corresponding time-period $[t_1]$ when the input voltage has full amplitude. Similarly, the time-period $[t_2', t_3']$ during which current flows through the second LED group 111 is substantially reduced with respect to the corresponding time-period $[t_2, t_3]$ when the input voltage has full amplitude. Because the lighting intensity produced by each of the first and second LED groups 109 and 111 is dependent on the total amount of current flowing through the LED groups, the shortening of the time-periods during which current flows through each of the LED groups causes the lighting intensity produced by each of the LED groups to be reduced.

In addition to providing dimmable lighting, the conditioning circuitry 100 of FIG. 1A can be used to provide color-dependent dimmable lighting. In order to provide color-dependent dimmable lighting, the first and second LED groups may include LEDs of different colors, or different combinations of LEDs having different colors. When a full amplitude voltage $V_{rect}$ is provided, the light output of the conditioning circuitry 100 is provided by both the first and second LED groups, and the color of the light output is determined based on the relative light intensity and the respective color light provided by each of the LED groups. As the amplitude of the voltage $V_{rect}$ is reduced, however, the light intensity provided by the second LED group will be reduced more rapidly than the light intensity provided by the first LED group. As a result, the light output of the conditioning circuitry 100 will gradually be dominated by the light output (and the color of light) produced by the first LED group.

The conditioning circuitry 100 shown in FIG. 1A includes first and second LED groups 109 and 111. Each LED group can be formed of one or more LEDs, or of one or more high-voltage LEDs. In examples in which a LED group includes two or more LEDs (or two or more high-voltage LEDs), the LEDs may be coupled in series and/or in parallel.

Figure 2A:
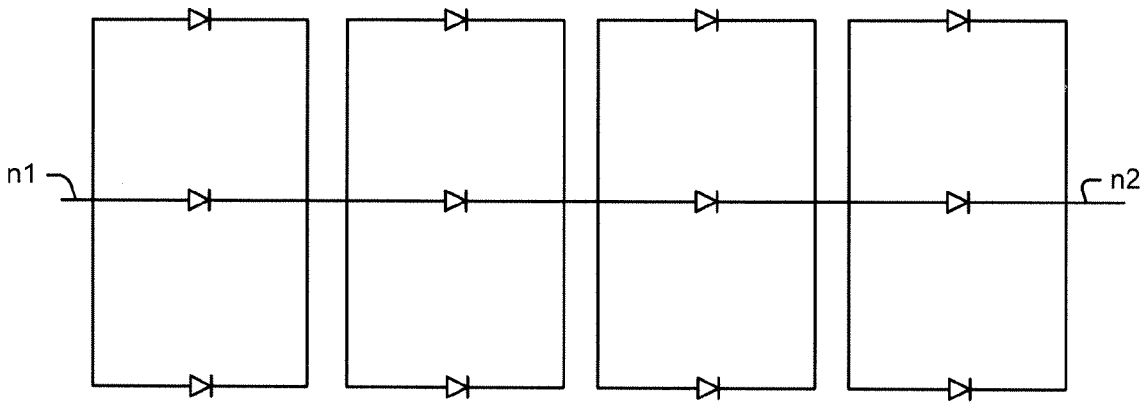
FIGS. 2A, 2B, 2C, and 2D are schematic diagrams showing various examples of interconnections of LEDs and of LED groups for use in the conditioning circuit of FIG. 1A.
Figure 2B:
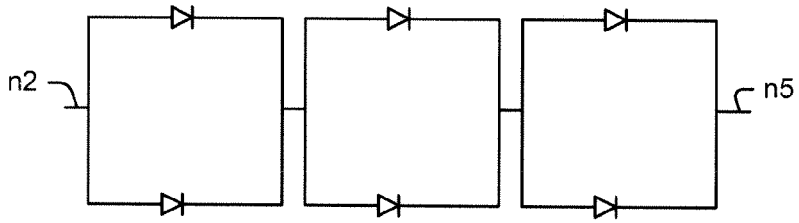

FIGS. 2A and 2B show examples of interconnections of LEDs that may be used as LED groups 109 and 111. In the example of FIG. 2A, an exemplary LED group (coupled between nodes n1 and n2, such as LED group 109 of FIG. 1A) is formed of four sub-groups of LEDs coupled in series, where each sub-group is a parallel interconnection of three LEDs. In the example of FIG. 2B, an exemplary LED group (coupled between nodes n2 and n5, such as LED group 111 of FIG. 1A) is formed of three sub-groups of LEDs coupled in series, where each sub-group is a parallel interconnection of two LEDs.

Various other interconnections of LEDs may be used. In another example, a first LED group may be formed of 22 sub-groups of LEDs coupled in series where each sub-group is a parallel interconnection of three LEDs, while a second LED group may be formed of 25 sub-groups of LEDs coupled in series where each sub-group is a parallel interconnection of two LEDs. The LEDs in a single group may be wire bonded to a single semiconductor die, or to multiple interconnected semiconductor dies.

In general, the structure of a LED group can be selected so as to provide the LED group with particular electrical parameters. For example, the threshold voltage of the LED group can be increased by coupling more LED sub-groups in series, while the maximum power (or maximum current) rating of the LED group can be increased by coupling more LEDs in parallel within each sub-group. As such, a LED group can be designed to have particular electric parameters, such as having a threshold voltage of 40 V, 50 V, 60 V, 70 V, 120 V, or other appropriate voltage level. Similarly, a LED group can be designed to have a particular power rating, such as a power rating of 2, 7, 12.5, or 16 watts.

Each LED group may further be formed of LEDs emitting light of the same or of different colors. For example, a LED group only including LEDs emitting a red light may emit a substantially red light, while a LED group including a mixture of LEDs emitting red light and white light may emit a reddish light.

As shown in the exemplary current timing of FIG. 1C, the maximum amplitude of the currents $I_{G1}$ and $I_{G2}$ through the first and second LED groups 109 and 111 is approximately the same. However, because the first LED group 109 conducts current for a longer period of time, the total power output by the first LED group 109 is generally higher than the total power output by the second LED group 111. In order to avoid over-driving the first LED group 109, the first and second LED groups 109 and 111 can include different interconnections of LEDs, as described in relation to FIGS. 2A and 2B above. In one example, the first LED group 109 may include more LEDs coupled in parallel than the second LED group 111, so as to reduce the maximum amplitude of current flowing through each LED of the first LED group 109 and thereby reduce the chances of over-driving the first LED group 109.

Figure 2C:
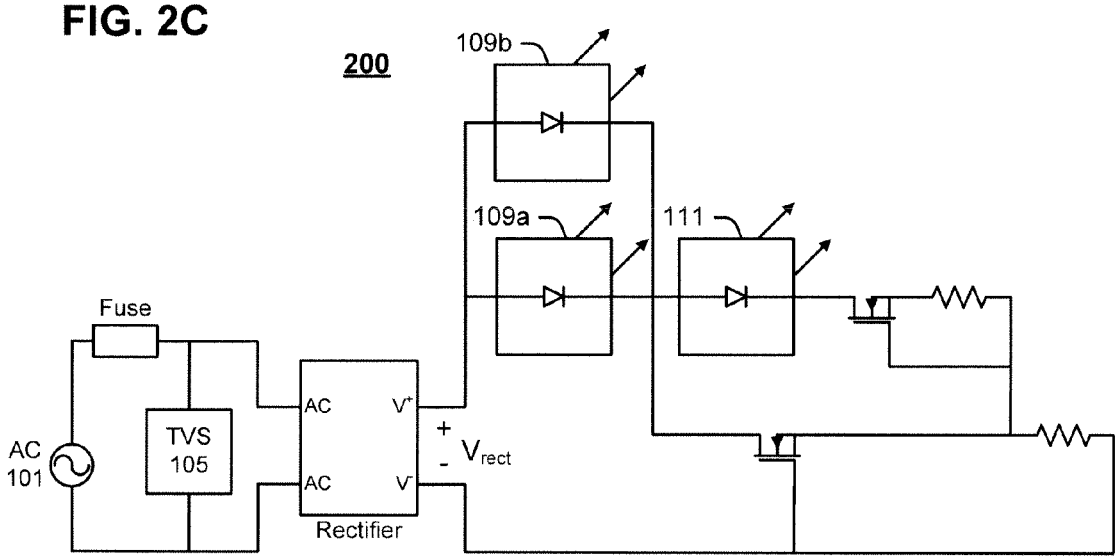
Figure 2D:
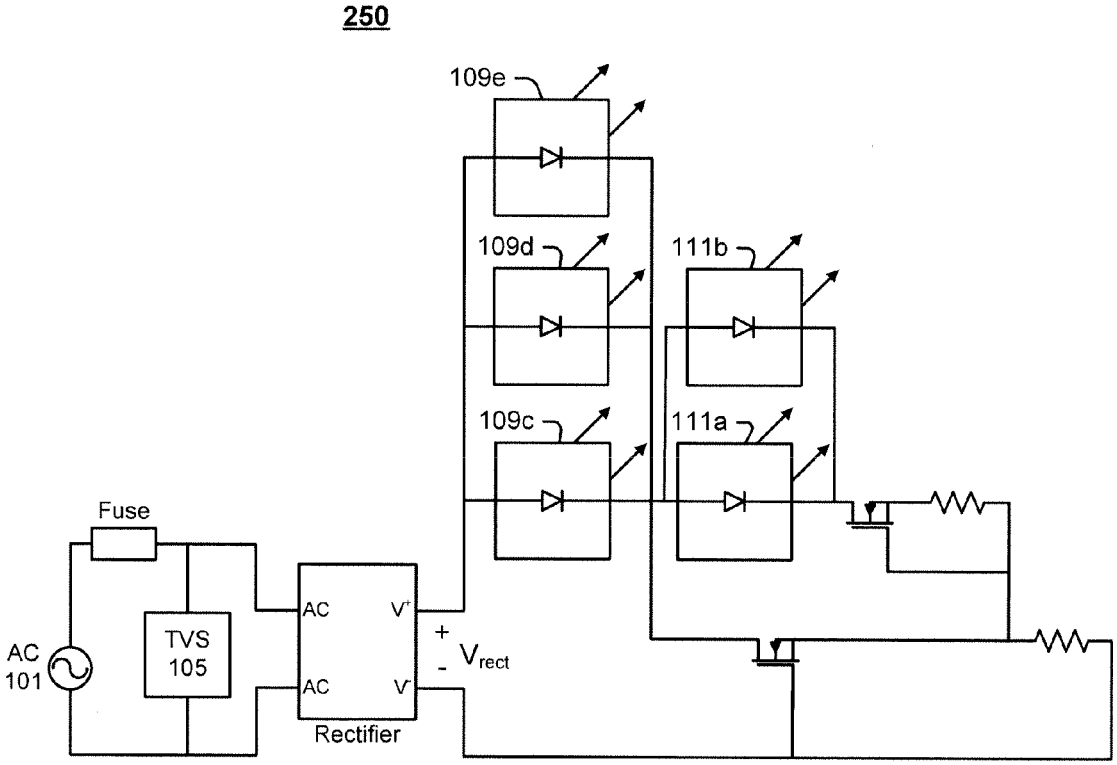

Alternatively, different numbers of LED groups may be used in the conditioning circuitry 100. FIGS. 2C and 2D show two examples in which conditioning circuitry 100 has been modified to include various numbers of LED groups.

For example, FIG. 2C shows conditioning circuitry 200 which is substantially similar to the conditioning circuitry 100. However, in the conditioning circuitry 200 of FIG. 2C, the first LED lighting group has been replaced by a parallel interconnection of two LED groups 109*a* and 109*b*. By providing two LED groups 109*a* and 109*b* coupled in parallel, one-half of the current $I_{G1}$ will flow through each of the LED groups 109*a* and 109*b*. The parallel interconnection of the two LED groups 109*a* and 109*b* can thus reduce the total current flowing through each LED group, and reduce the total power output by each LED group. The parallel interconnection may thus minimize the chances that either of the LED groups 109*a* and 109*b* will suffer from over-driving.

FIG. 2D shows another exemplary conditioning circuit 250 which is substantially similar to conditioning circuit 100. However, in conditioning circuit 250, the first LED lighting group has been replaced by a parallel interconnection of three LED groups 109*c*, 109*d*, and 109*e*. Additionally, the second LED lighting group 111 has been replaced by a parallel interconnection of two LED groups 111*a* and 111*b*. As described in relation to FIG. 2C, the parallel interconnection of two or more LED groups in parallel may reduce the total current flowing through each LED group, and reduce the chances that any LED group will suffer from over-driving.

Figure 3A:
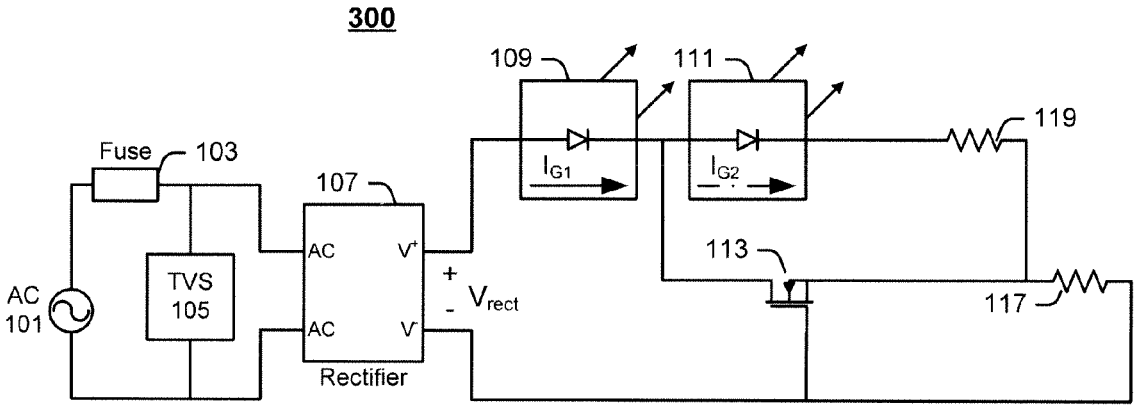
FIG. 3A is a schematic diagram showing a modified conditioning circuit for driving two LED groups using a rectified AC input voltage.

FIG. 3A shows a schematic diagram of a modified conditioning circuit 300 for driving two LED groups using a rectified AC input voltage. The modified conditioning circuit 300 is substantially similar to the conditioning circuit 100 of FIG. 1A. However, modified circuit 300 does not include the second depletion MOSFET transistor 115 of circuit 100. Instead, the cathode of the second LED group 111 is coupled directly to the second resistor 119.

The circuit 300 functions substantially similarly to circuit 100. As described in relation to FIGS. 1B and 1C, the first LED group 109 of circuit 300 will conduct current during a first time-period $[t_1, t_4]$, while the second LED group 111 of circuit 300 will conduct current during second time-period $[t_2, t_3]$. However, because the circuit 300 does not include the depletion MOSFET transistor 115, the peak current flowing through the first and second LED groups during the time-period $[t_2, t_3]$ is not limited by the conductance of the depletion MOSFET transistor 115. As a result, the current flowing through the first and second LED groups in circuit 300 may peak with a higher value than in the circuit 100. The circuit 300 may, however, have lower lighting efficiency than the circuit 100 because more power is dissipated by the second resistor 119.

Figure 3B:
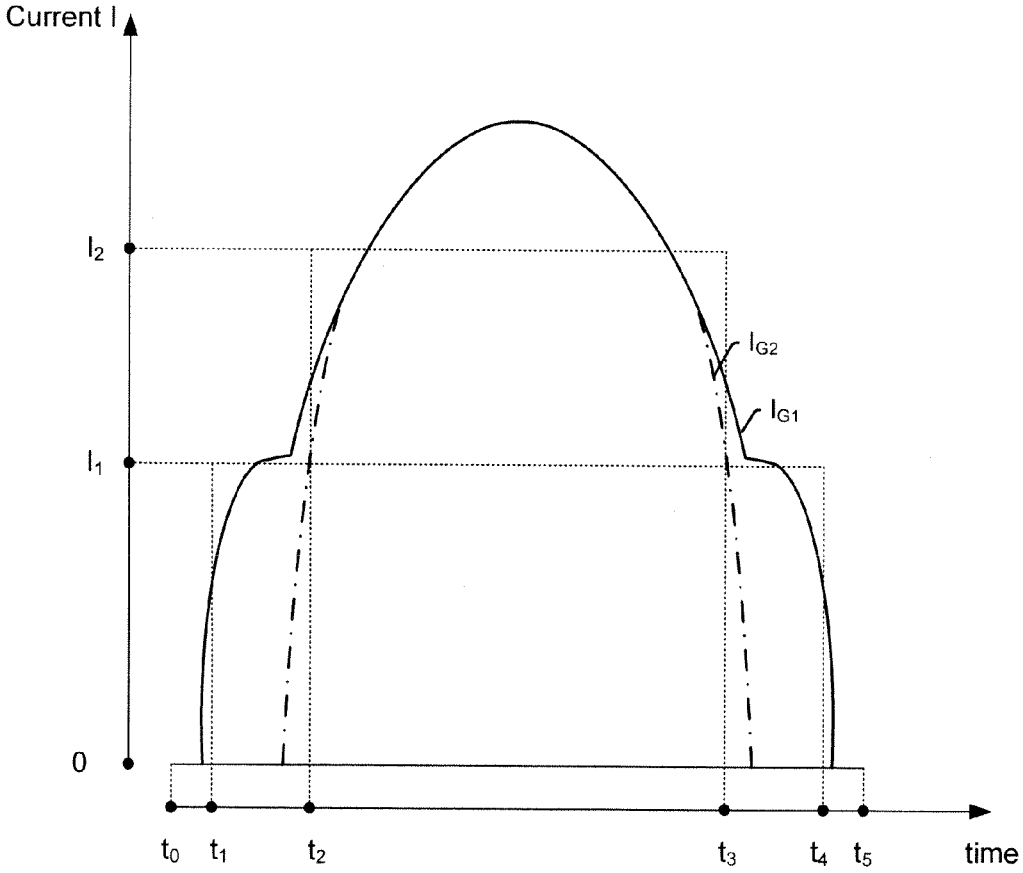
FIG. 3B is a current timing diagram illustratively showing the operation of the conditioning circuit of FIG. 3A.

FIG. 3B is a current timing showing the currents $I_{G1}$ and $I_{G2}$ respectively flowing through the first and second LED groups 109 and 111 of circuit 300 during one cycle. As shown in FIG. 3B, the current flows through circuit 300 are generally similar to the current flows through circuit 100 and shown in FIG. 1C. However, the peak amplitudes reached by the currents $I_{G1}$ and $I_{G2}$ in circuit 300 (as shown in FIG. 3B) are higher than the peak amplitudes reached in circuit 100 (as shown in FIG. 1C).

Figure 4A:
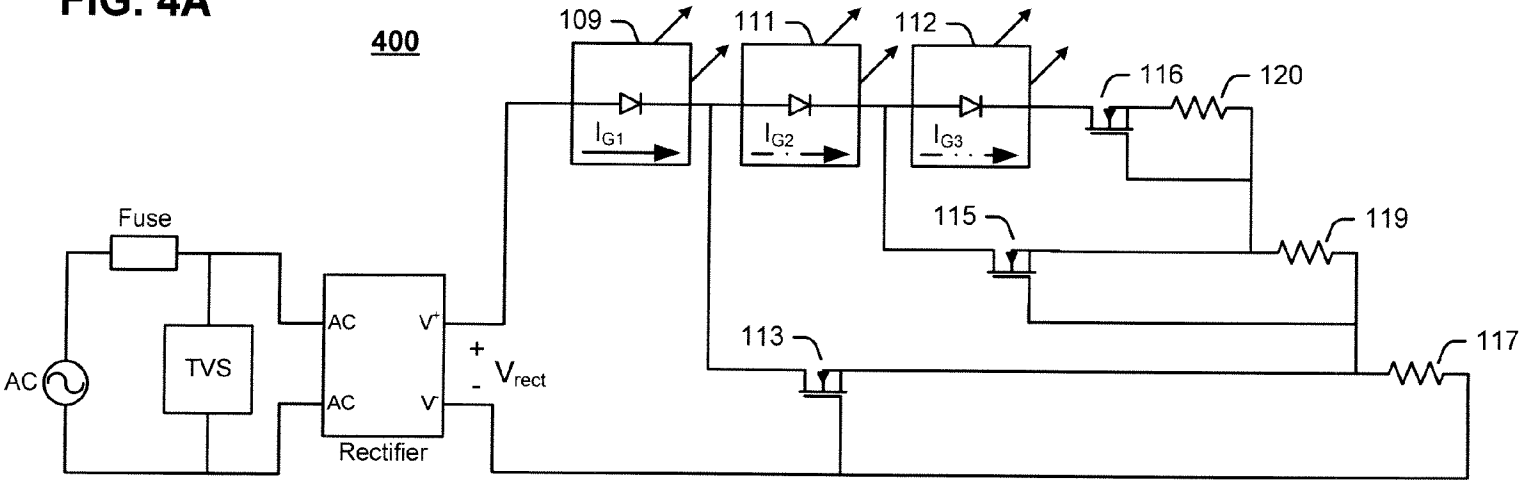
FIG. 4A is a schematic diagram showing a modified conditioning circuit for driving three LED groups using a rectified AC input voltage.

FIG. 4A shows a schematic diagram of a modified circuit 400 for driving three LED groups using a rectified AC input voltage. The modified circuit 400 is substantially similar to the conditioning circuit 100 of FIG. 1A. However, modified circuit 400 includes a series interconnection of a third LED group 112, a third depletion MOSFET transistor 116, and a third resistor 120 coupled between the cathode of the second LED group 111 and the source of the second depletion MOSFET transistor 115.

The modified circuit 400 functions similarly to LED lighting circuit 100. However, the modified circuit 400 selectively routes current to zero, one, two, or all three of the LED groups depending on the instantaneous value of the rectified driving voltage $V_{rect}$. The modified circuit 400 may have three voltage thresholds $V_1$, $V_2$, and $V_3$ at which different LED groups are activated. In particular, the first LED group 109 may be activated for a period $[t_1, t_4]$ during which the driving voltage $V_{rect}$ exceeds the first voltage threshold $V_1$, the second LED group 111 may be activated for a period $[t_2, t_3]$ during which the driving voltage $V_{rect}$ exceeds the second voltage threshold $V_2$, and the third LED group 112 may be activated for a period $[t_{21}, t_{22}]$ during which the driving voltage $V_{rect}$ exceeds the third voltage threshold $V_3$. The voltage thresholds may be such that $V_1<V_2<V_3$, and the time-periods may be such that $[t_{21}, t_{22}]$ forms part of $[t_2, t_3]$, and such that $[t_2, t_3]$ forms part of $[t_1, t_4]$.

Figure 4B:
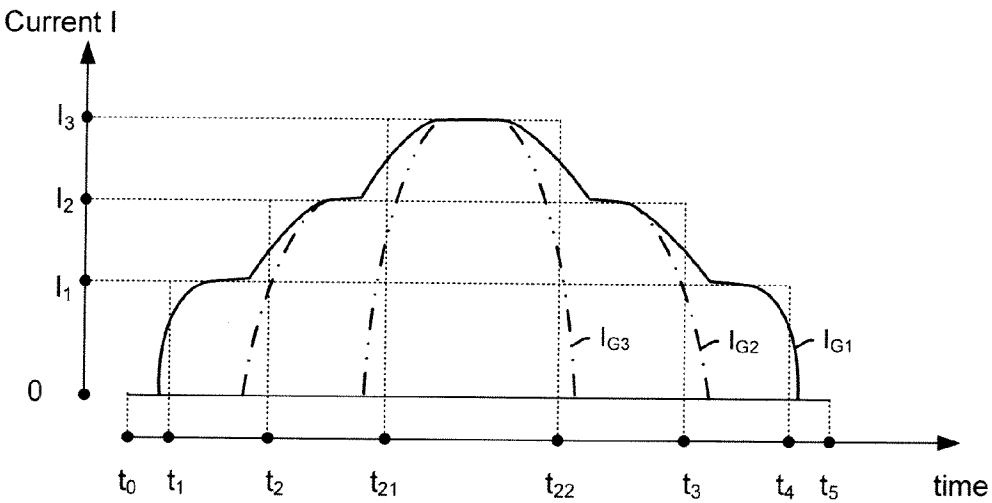
FIG. 4B is a current timing diagram illustratively showing the operation of the conditioning circuit of FIG. 4A.

FIG. 4B is a current timing diagram showing the currents $I_{G1}$, $I_{G2}$, and $I_{G3}$ respectively flowing through the first, second, and third LED groups 109, 111, and 112 during one cycle of operation of the circuit 400. As shown in FIG. 4B, the first and second LED groups function substantially similarly to those shown in FIG. 1C. In particular, according to the timing diagram of FIG. 4B, a current $I_{G1}$ flows through the first LED group 109 during the period $[t_1, t_4]$, while a current $I_{G2}$ flows through the second LED group 111 during the period $[t_2, t_3]$. However, in the circuit 400, the current $I_{G3}$ additionally flows through the third LED group 112 during the period $[t_{21}, t_{22}]$.

In circuit 400, electrical parameters of the components can be selected to adjust the functioning of the circuit 100. For example, the voltage $V_1$ may be substantially equal to the forward voltage of the first LED group, while the voltage $V_2$ may be substantially equal to the sum of the forward voltages of the first and second LED groups and the voltage $V_3$ may be substantially equal to the sum of the forward voltages of the first, second, and third LED groups. In one example, the forward voltage of the first LED group may be set to a value of 40V, for example, while the forward voltages of the second and third LED group may be set to values of 30V each, such that the voltages $V_1$, $V_2$, and $V_3$ are respectively approximately equal to 40V, 70V, and 100V. In addition, the value of the first resistor 117 may be set such that the first depletion MOSFET transistor 113 enters a non-conducting state when the voltage $V_{rect}$ reaches a value of $V_2$, and the value of the second resistor 119 may be set such that the second depletion MOSFET transistor 115 enters a non-conducting state when the voltage $V_{rect}$ reaches a value of $V_3$.

While LED lighting circuits have been presented that selectively drive two LED groups 109 and 111 (see FIG. 1A, circuit 100) and that selectively drive three LED groups 109, 111, and 112 (see FIG. 4A, circuit 400), the teachings contained herein can more generally be used to design circuits that drive four or more LED groups. For example, a circuit driving four LED groups may be substantially similar to circuit 400, but may include an additional series interconnection of a fourth LED group, a fourth depletion MOSFET transistor, and a fourth resistor coupled between the cathode of the third LED group 112 and the source of the third depletion MOSFET transistor 116. Similarly, a circuit driving five LED groups may be substantially similar to the circuit driving four LED groups, but may include an additional interconnection of a fifth LED group, a fifth depletion MOSFET transistor, and a fifth resistor coupled between the cathode of the fourth LED group and the source of the fourth depletion MOSFET transistor.

Figure 5A:
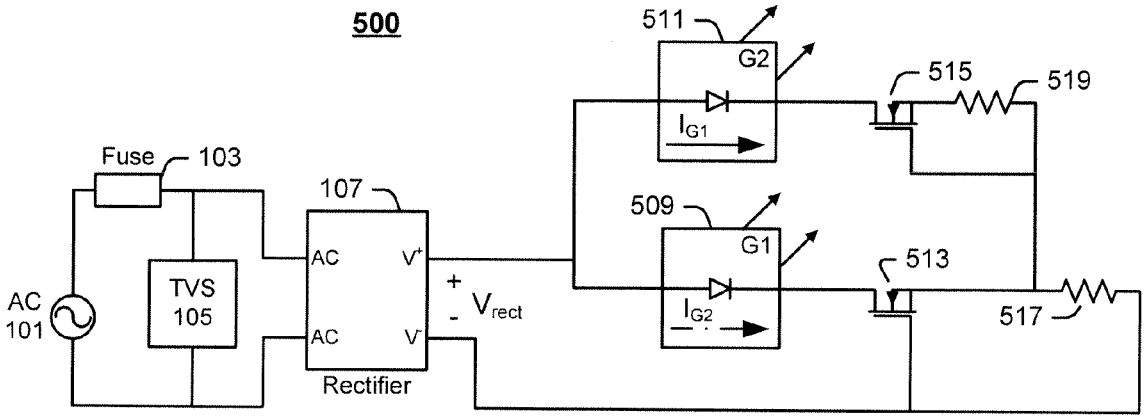
FIG. 5A is a schematic diagram showing a modified conditioning circuit for driving two LED groups using a rectified AC input voltage.

FIG. 5A shows a schematic diagram of a modified circuit 500 for driving two LED groups using a rectified AC input voltage. The modified circuit 500 is similar to the conditioning circuit 100 of FIG. 1A. However, in modified circuit 500, the first and second LED groups 509 and 511 are coupled in parallel and may therefore be substantially alternately provided with a driving current (instead of being substantially concurrently provided with a driving current, as in circuit 100).

In particular, in circuit 500, the first series interconnection of the first LED group 509, the first depletion MOSFET transistor 513 (coupled by the drain and source terminals), and the first resistor 517 is coupled between the output nodes $V^+$ and $V^-$ of the voltage rectifier 107. The gate terminal of the first depletion MOSFET transistor 513 is coupled to the node $V^-$. However, the second series interconnection of the second LED group 511, the second depletion MOSFET transistor 515 (coupled by the drain and source terminals), and the second first resistor 519 is coupled between the output node $V^+$ of the voltage rectifier 107 and the source terminal of the first depletion MOSFET transistor 513. The gate terminal of the second depletion MOSFET transistor 515 is coupled to the source terminal of the first depletion MOSFET transistor 513.

Figure 5B:
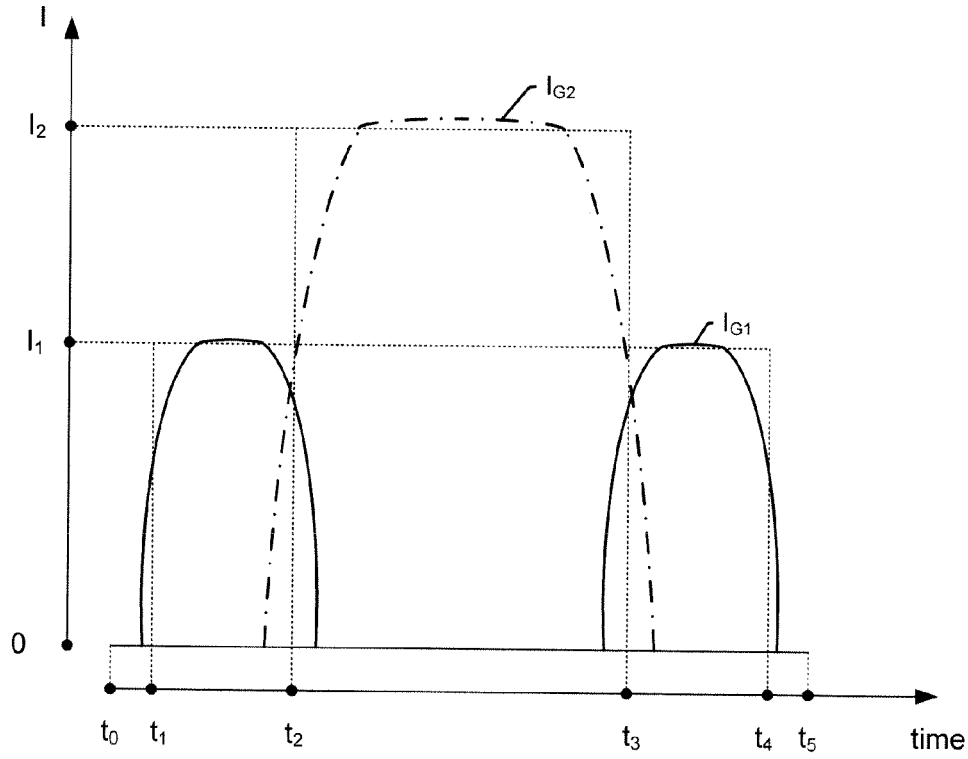
FIGS. 5B and 5C are a current timing diagram and a lighting intensity diagram illustratively showing the operation of the conditioning circuit of FIG. 5A.

The functioning of the circuit 500 will be explained with reference to the current timing diagram of FIG. 5B. As in the case of conditioning circuit 100, conditioning circuit 500 has first and second voltage thresholds $V_1$ and $V_2$, and the rectified driving voltage $V_{rect}$ respectively exceeds the first and second thresholds during time-periods $[t_1, t_4]$ and $[t_2, t_3]$ of each cycle.

Because the first and second LED groups 509 and 511 are not coupled in series, however, the current $I_{G1}$ flowing through the first LED group 509 does not flow through the second LED group 511, and the current $I_{G2}$ flowing through the second LED group 511 does not flow through the first LED group 509. As a result, as the first MOSFET depletion transistor 513 enters and operates in a non-conducting state (period $[t_2, t_3]$), the current $I_{G1}$ through the first LED group 509 is reduced or cut-off. As a result, the first LED group 509 turns substantially off (and stops emitting light) during the period $[t_2, t_3]$. Meanwhile, the second LED group 511 of circuit 500 functions substantially as in circuit 100. In particular, the second LED group 511 conducts current (and emits light) during the period $[t_2, t_3]$.

Electrical parameters for circuit 500 can be selected to adjust the functioning of the circuit. For example, the forward voltages of the first and second LED groups 509 and 511 may determine the value of the voltages $V_1$ and $V_2$ at which the first and second LED groups are activated. In particular, the voltage $V_1$ may be substantially equal to the forward voltage of the first LED group, while the voltage $V_2$ may be substantially equal to the forward voltage of the second LED group. In one example, the forward voltage of the first LED group may be set to a value of 60V, for example, while the forward voltage of the second LED group may be set to a value of 100V, such that the voltage $V_1$ is approximately equal to 60V and the voltage $V_2$ is approximately equal to 100V. In addition, the value of the first resistor 117 may be set such that the first depletion MOSFET transistor 113 enters a non-conducting state when the voltage $V_{rect}$ reaches a value of $V_2$. As such the value of the first resistor 117 may be set based on the threshold voltage of the first depletion MOSFET transistor 513, the drain-source resistance of the first depletion MOSFET transistor 513, and the voltages $V_1$ and $V_2$.

The functioning of LED lighting circuit 500 may present an advantage in terms of providing a constant lighting intensity even in situations in which a driving voltage amplitude is variable. As described in relation to FIG. 1D, as the amplitude of the rectified voltage $V_{rect}$ decreases, the length of the periods $[t_1, t_4]$ and $[t_2, t_3]$ during which the first and second LED groups emit light correspondingly decreases. As a result, the total lighting intensity produced by the LED groups is reduced. The LED lighting circuit 500, however, may provide a relatively constant lighting intensity even as the amplitude of the rectified voltage $V_{rect}$ undergoes small variations.

Figure 5C:
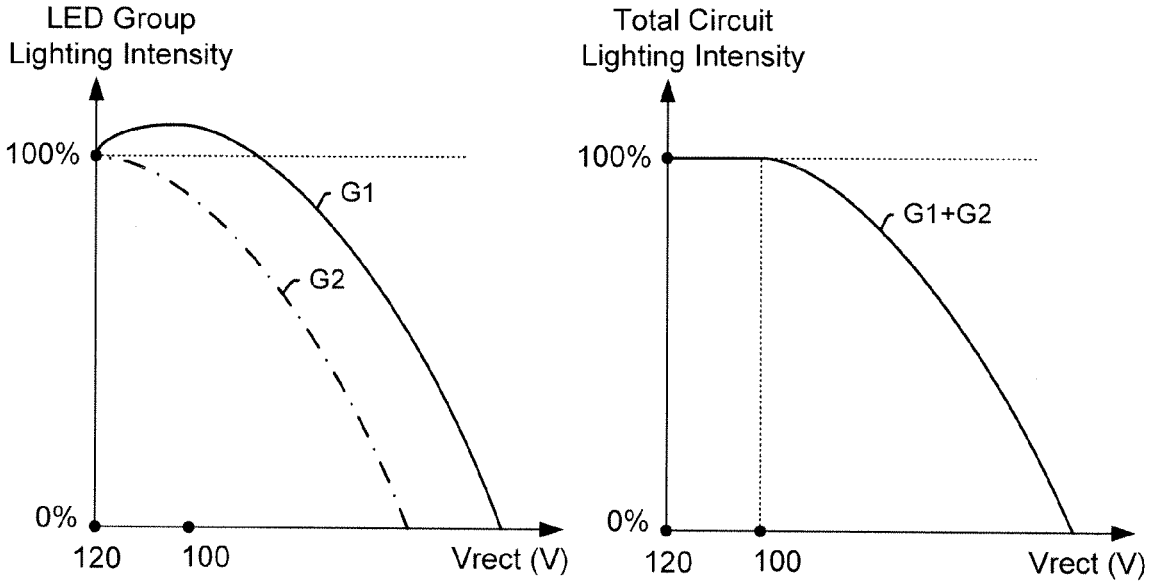

FIG. 5C shows a first diagram showing the relative lighting intensity of the first and second LED groups G1 and G2 according to the amplitude of the driving voltage $V_{rect}$. The lighting intensity is normalized, for each LED group, to a value of 100% for a driving voltage amplitude of 120V. As the amplitude of the driving voltage decreases below 120V, the lighting intensity of the second LED group G2 gradually decreases below 100%. However, as the amplitude of the driving voltage decreases below 120V, the lighting intensity of the first LED group G1 initially increases before decreasing for low driving voltage amplitudes. As a result, the total lighting intensity produced by the LED circuitry (i.e., the total lighting intensity provided by the combination of the first and second LED groups G1+G2) remains relatively constant for a range of amplitudes of input voltage (e.g., the range of amplitudes [120V, 100V], in the example of FIG. 5C), before decreasing for low driving voltage amplitudes. The LED lighting circuitry 500 may therefore advantageously be used to provide a constant lighting intensity in the face of a variable power supply amplitude, while nonetheless enabling the lighting intensity to be dimmed at lower power supply amplitudes. For example, the LED lighting circuit 500 can provide a constant lighting intensity even when variations in supply amplitude caused by transients on a power line occur.

The various modifications to the conditioning circuit 100 described herein can be applied to the conditioning circuit 500. For example, the conditioning circuit 500 can include various interconnections of LEDs and of LED groups, such as the serial and parallel interconnections of LEDs and of LED groups described herein in relation to FIGS. 2A-2D. In another example, the second transistor 515 may optionally be removed from the conditioning circuit 500, and the cathode of the second LED group 511 coupled to the first terminal of the resistor 519. In yet another example, additional series interconnections of an LED group, a depletion MOSFET transistor, and a resistor may be included in the conditioning circuit 500. For instance, a third series interconnection of a third LED group, a third depletion MOSFET transistor, and a third resistor can be coupled between the anode of the first LED group 509 and the source of the second depletion MOSFET transistor 515. The gate terminal of the third depletion MOSFET transistor would then be coupled to the source of the second depletion MOSFET transistor 515. Similarly, a fourth series interconnection of a fourth LED group, a fourth depletion MOSFET transistor, and a fourth resistor can be coupled between the anode of the first LED group 509 and the source of the third depletion MOSFET transistor. The gate terminal of the fourth depletion MOSFET transistor would then be coupled to the source of the third depletion MOSFET transistor.

The conditioning circuits shown and described in this application, including the conditioning circuit 100, 200, 250, 300, 400, and 500 shown in the figures, and the various modifications to conditioning circuits described in the application, are configured to drive LED lighting circuits with reduced or minimal total harmonic distortion. By using analog circuitry which gradually and selectively routes current to various LED groups, the conditioning circuits provide a high lighting efficiency by driving one, two, or more LED groups based on the instantaneous value of the driving voltage.

Furthermore, by using depletion MOSFET transistors with elevated drain-source resistances $r_{ds}$, the depletion MOSFET transistors transition between the saturation and cutoff modes relatively slowly. As such, by ensuring that the transistors gradually switch between conducting and non-conducting states, the switching on and off of the LED groups and transistors follows substantially sinusoidal contours. As a result, the circuitry produces little harmonic distortion as the LED groups are gradually activated and deactivated. In addition, the first and second (or more) LED groups control current through each other: the forward voltage level of the second LED group influences the current flow through the first LED group, and the forward voltage level of the first LED group influences the current flow through the second LED group. As a result, the circuitry is self-controlling through the interactions between the multiple LED groups and multiple MOSFET transistors.

In one aspect, the term "field effect transistor (FET)" may refer to any of a variety of multi-terminal transistors generally operating on the principals of controlling an electric field to control the shape and hence the conductivity of a channel of one type of charge carrier in a semiconductor material, including, but not limited to a metal oxide semiconductor field effect transistor (MOSFET), a junction FET (JFET), a metal semiconductor FET (MESFET), a high electron mobility transistor (HEMT), a modulation doped FET (MODFET), an insulated gate bipolar transistor (IGBT), a fast reverse epitaxial diode FET (FREDFET), and an ion-sensitive FET (ISFET).

In one aspect, the terms "base," "emitter," and "collector" may refer to three terminals of a transistor and may refer to a base, an emitter and a collector of a bipolar junction transistor or may refer to a gate, a source, and a drain of a field effect transistor, respectively, and vice versa. In another aspect, the terms "gate," "source," and "drain" may refer to "base," "emitter," and "collector" of a transistor, respectively, and vice versa.

Unless otherwise mentioned, various configurations described in the present disclosure may be implemented on a Silicon, Silicon-Germanium (SiGe), Gallium Arsenide (GaAs), Indium Phosphide (InP) or Indium Gallium Phosphide (InGaP) substrate, or any other suitable substrate.

A reference to an element in the singular is not intended to mean "one and only one" unless specifically so stated, but rather "one or more." For example, a resistor may refer to one or more resistors, a voltage may refer to one or more voltages, a current may refer to one or more currents, and a signal may refer to differential voltage signals.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

A phrase such as an "example" or an "aspect" does not imply that such example or aspect is essential to the subject technology or that such aspect applies to all configurations of the subject technology. A disclosure relating to an example or an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such as an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect of the disclosure, when actions or functions are described as being performed by an item (e.g., routing, lighting, emitting, driving, flowing, generating, activating, turning on or off, selecting, controlling, transmitting, sending, or any other action or function), it is understood that such actions or functions may be performed by the item directly or indirectly. In one aspect, when a module is described as performing an action, the module may be understood to perform the action directly. In one aspect, when a module is described as performing an action, the module may be understood to perform the action indirectly, for example, by facilitating, enabling or causing such an action.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

In one aspect, the term "coupled", "connected", "interconnected", or the like may refer to being directly coupled, connected, or interconnected (e.g., directly electrically coupled, connected, or interconnected). In another aspect, the term "coupled", "connected", "interconnected", or the like may refer to being indirectly coupled, connected, or interconnected (e.g., indirectly electrically coupled, connected, or interconnected).

The disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. §101, 102, or 103, nor should they be interpreted in such a way. Any unintended embracement of such subject matter is hereby disclaimed.

What is claimed is:

1. A circuit comprising:

a first series interconnection of a first light-emitting diode (LED) group, a first transistor, and a first resistor;

a second series interconnection of a second LED group, a second transistor, and a second resistor, wherein:

the second series interconnection is connected between a drain terminal and a source terminal of the first transistor, and the first and second LED groups are selectively activated by a variable voltage applied across the first series interconnection; and a rectifier receiving an AC driving voltage at a pair of input terminals, rectifying the received AC driving voltage, and outputting the rectified voltage as the variable voltage at a pair of output nodes, wherein:

an anode of the first LED group is coupled to one of the pair of output nodes of the rectifier;

a cathode of the first LED group is coupled to the drain terminal of the first transistor;

the source terminal of the first transistor is coupled to a first terminal of the first resistor; and a gate terminal of the first transistor is coupled to a second terminal of the first resistor and to the other of the pair of output nodes of the rectifier.

2. The circuit according to claim 1, wherein:

an anode of the second LED group is coupled to the drain terminal of the first transistor;

a cathode of the second LED group is coupled to a drain terminal of the second transistor;

a source terminal of the second transistor is coupled to a first terminal of the second resistor; and a gate terminal of the second transistor is coupled to a second terminal of the second resistor and to the source terminal of the first transistor.

3. The circuit according to claim 1, further comprising:

a third series interconnection of a third LED group, a third transistor, and a third resistor, wherein:

the third series interconnection is connected between a drain terminal and a source terminal of the second transistor.

4. The circuit according to claim 1, wherein the first and second transistors are depletion MOSFET transistors.

5. The circuit according to claim 4, wherein:

the first resistor is coupled between the source terminal and a gate terminal of the first transistor, and the first transistor transitions from a conducting state to a non-conducting state when the variable voltage exceeds a first threshold.

6. The circuit according to claim 5, wherein:

the second LED group is selectively activated when the variable voltage exceeds the first threshold.

7. The circuit according to claim 5, wherein:

the first and second LED groups have respective threshold voltages, the first LED group is activated when the variable voltage exceeds the threshold voltage of the first LED group, and the second LED group is activated when the variable voltage exceeds the sum of the threshold voltages of the first and second LED groups.

8. A circuit comprising:

a first series interconnection of a first light-emitting diode (LED) group, a first transistor, and a first resistor; and a second series interconnection of a second LED group, a second transistor, and a second resistor, wherein:

the second series interconnection is connected between an anode of the first LED group and a source terminal of the first transistor, and the first and second LED groups are selectively activated by a variable voltage applied across the first series interconnection; and a rectifier receiving an AC driving voltage at a pair of input terminals, rectifying the received AC driving voltage, and outputting the rectified voltage as the variable voltage at a pair of output nodes, and wherein:

the anode of the first LED group is coupled to one of the pair of output nodes of the rectifier;

a cathode of the first LED group is coupled to a drain terminal of the first transistor;

the source terminal of the first transistor is coupled to a first terminal of the first resistor; and a gate terminal of the first transistor is coupled to a second terminal of the first resistor and to the other of the pair of output nodes of the rectifier.

9. The circuit according to claim 8, wherein:

an anode of the second LED group is coupled to the anode of the first LED group;

a cathode of the second LED group is coupled to a drain terminal of the second transistor;

a source terminal of the second transistor is coupled to a first terminal of the second resistor; and a gate terminal of the second transistor is coupled to a second terminal of the second resistor and to the source terminal of the first transistor.

10. The circuit according to claim 8, further comprising:

a third series interconnection of a third LED group, a third transistor, and a third resistor, wherein:

the third series interconnection is connected between the anode of the first LED group and a source terminal of the second transistor.

11. The circuit according to claim 8, wherein the first and second transistors are depletion MOSFET transistors.

12. The circuit according to claim 11, wherein:

the first resistor is coupled between the source terminal and a gate terminal of the first transistor, and the first transistor transitions from a conducting state to a non-conducting state when the variable voltage exceeds a first threshold.

13. The circuit according to claim 12, wherein:

the second LED group is activated when the variable voltage exceeds the first threshold.

14. The circuit according to claim 12, wherein:

the first and second LED groups have respective threshold voltages, the first LED group is activated when the variable voltage exceeds the threshold voltage of the first LED group and does not exceed the first threshold, and the second LED group is activated when the variable voltage exceeds the threshold voltage of the second LED groups.

* * * * *